US005858564A

United States Patent [19]

Tamura et al.

[11] Patent Number: 5,858,564

[45] Date of Patent: Jan. 12, 1999

[54] ORGANIC ELECTROLUMINESCENT DEVICES AND LUMINESCENT DISPLAY EMPLOYING SUCH ORGANIC ELECTROLUMINESCENT DEVICES

[75] Inventors: Shin-Ichiro Tamura; Tadashi Ishibashi, both of Kanagawa, Japan

[73] Assignee: Sony Corporation, Tokyo, Japan

[21] Appl. No.: 993,863

[22] Filed: Dec. 18, 1997

[30] Foreign Application Priority Data

Dec. 27, 1996 [JP] Japan ..... 8-350713

[51] Int. Cl.[6] ..... H05B 33/00

[52] U.S. Cl. ..... 428/690; 428/917; 313/503; 313/504; 313/506; 252/301.16

[58] Field of Search ..... 428/690, 917; 313/503, 504, 506; 252/301.16

[56] References Cited

U.S. PATENT DOCUMENTS 5,443,922 8/1995 Nishizaki et al. ..... 428/690

FOREIGN PATENT DOCUMENTS 42 36 885 A1 5/1994 Germany .
195 12 773 A1 10/1996 Germany .
WO 96/22332 7/1996 WIPO .

*Primary Examiner*—Charles Nold
*Attorney, Agent, or Firm*—Hill & Simpson

[57] ABSTRACT

An electroluminescent element of the type having a anode, an cathode, and an organic layer which contains a luminescent zone and is held between said anode and cathode, characterized in that said luminescent zone contains quaterterrylene or a derivative thereof as the luminescent material.

13 Claims, 8 Drawing Sheets

ORGANIC ELECTROLUMINESCENT DEVICES AND LUMINESCENT DISPLAY EMPLOYING SUCH ORGANIC ELECTROLUMINESCENT DEVICES

BACKGROUND OF THE INVENTION

1. Field of the Invention

The present invention relates to an electroluminescent element (suitable for the flat display of self-luminous type which employs an organic thin film as the luminescent layer) and a luminescent display employing the same.

2. Prior Art

Nowadays, growing importance is attached to the human interface with machines, particularly multimedia-oriented ones. For efficient, comfortable operation, man needs ample, correct, concise information from the machine being operated. To this end, much has been studied about display elements.

Among other things, the lightweight, high-efficiency flat panel display is expected to be suitable as the computer screen and television screen. On the other hand, at present the cathode-ray tube is most commonly used as display because of its high luminance and good color reproducibility. However, it still has the disadvantage of being bulky and heavy and consuming much electricity, which should be eliminated in the future.

An example of the flat panel display is the liquid-crystal display of active matrix type which is commercially available. Unfortunately, it suffers several disadvantages. That is, it has a narrow viewing angle; it consumes much electricity for back-light during use in the dark (because it is not self-luminous); it does not respond quickly to the high-speed fine video signals which are expected to be put to practical use in the future; and it costs money for the large-sized screen.

A potential substitute for this is the light-emitting diode. However, it still has a problem with production cost. In addition, it involves difficulty in producing a matrix of light-emitting diodes on a single substrate. There still is a long distance to go for the practical, low-priced substitute for the cathode-ray tube.

A promising flat panel display free from the above-mentioned disadvantages is one which employs an organic luminescent material. By virtue of organic luminescent material, this flat panel display is self-luminous, capable of high-speed response, and independent of viewing angle.

FIG. 1 shows an example of the conventional electroluminescent (EL) element 10 that employs an organic luminescent material. This organic EL element 10 is of double-hetero type which is composed of an ITO (indium tin oxide) transparent electrode 5, a hole transport layer 4, a luminescent layer 3, an electron transport layer 2, and an cathode (such as aluminum electrode) 1, which are formed consecutively by vacuum deposition on a transparent substrate (such as glass substrate) 6.

It functions when a dc voltage 7 is selectively applied across the transparent electrode 5 (as the anode) and the cathode 1. This voltage application injects holes (as carriers) from the transparent electrode 5 and injects electrons from the cathode 1. The holes move through the hole transport layer 4 and the electrons move though the electron transfer layer 2. Thus the electron-hole recombination occurs, thereby emitting the light 8 of prescribed wavelength which is visible through the transparent substrate 6.

The luminescent layer 3 contains a luminescent substance such as anthracene, naphthalene, phenanthrene, pyrene, curine, perylene, butadiene, coumarin, acridine, stilbene, and europium complex. The luminescent substance may be contained in the electron transport layer 2.

FIG. 2 shows another example of the conventional electroluminescent (EL) element 20 that employs an organic luminescent material. This organic EL element 20 is of single-hetero type which lacks the luminescent layer 3. Instead, it has the luminescent substance contained in the electron transport layer 2, so that light 18 of prescribed wavelength emits from the interface between the electron transport layer 2 and the hole transport layer 4.

FIG. 3 shows an example of the above-mentioned organic EL element in practical use. It has the organic layers (the hole transport layer 4 and the electron transport layer 2 or the luminescent layer 3) in the form of stripy laminates. The stripy laminates are interposed between stripy cathodes 1 and stripy anodes 5 which intersect with each other so that these electrodes form a matrix. The matrix receives signal voltages sequentially from the luminance signal circuit 40 and the control circuit 41 containing a shift register, so that a number of intersections (pixels) emit light.

This construction permits the EL element to be used as a display unit as well as an image reproducing unit. Incidentally, the EL element produces full-color or multicolor if each stripy pattern is assigned to R (red), G (green), and B (blue).

In the above-mentioned display device composed of a plurality of pixels, the organic EL element is constructed such that the luminescent organic thin film layers 2, 3, and 4 are held between the transparent electrode 5 and the metal electrode 1 so that light is visible through the transparent electrode 5.

As mentioned above, an organic thin film containing a luminescent material is held between a transparent anode and a metal cathode so as to construct the organic luminescent element.

An organic electroluminescent element of double-hetero structure in which a perylene thin film is used for red luminescence was reported by C. Adachi, S. Tokito, T. Tsutui, and S. Saito in Japanese Journal of Applied Physics, vol. 27, No. 2, pp. L269–L271 (1988). There was reported an investigation into the use of a perylene derivative as the luminescent material.

For example, the use of a thin film of N,N'-dimethyl-3,4,9,10-perylenedicarboimide held between metal electrodes was reported by M. Hiramoto, T. Imahigashi, and M. Yokoyamo in Applied Physics Letters, vol. 64, No. 2, pp. 187–189.

An organic EL element of double-hetero structure which employs as the luminescent layer a thin film of N,N'-bis(2,5-di-tert-butylphenyl)-3,4,9,10-perylenedicarboimide held between the hole transport layer and the electron transport layer was also reported by T. Katsunuma, M. Hiramoto, and M. Yokoyama in Applied Physics Letters, vol. 64, No. 19, pp. 2546–2548.

An organic EL element that emits red light by means of a tris (theonyltrifluoroacetonato) -Eu (III) complex contained in poly(methylphenylsilane) was reported by J. Kido, K. Nagai, Y. Okamoto, and T. Skotheim in Chemistry Letters, 1991, pp. 1267–1270.

An organic EL element of double-hetero structure which employs as the luminescent layer a tris(1,3-diphenyl-1,3-propanedino) (1,10-phenanthroline)-Eu (III) complex contained in 2-(4-biphenyl)-5-phenyl-1,3,4-oxazol was reported by J. Kido, H. Hayase, K. Hongawa, K. Nagai, and K.

Okuyama in Applied Physics Letters, vol. 65, No. 17, pp. 2124–2126 (1994).

An organic EL element of double-hetero structure (for a microoptical resonator) which employs as the luminescent layer a thin film of tris(theonyltrifluoroacetonato) (4,7-dipheyl-1,10-phenanthroline)-Eu(III) complex was reported by N. Takada, T. Tsutsui, and S. Saito in Japanese Journal of Applied Physics, vol. 33, Part 2, No. 6B, pp. L863–L866 (1994).

An organic EL element that emits red light by means of a tris(theonyltrifluoroacetonato)(1,10-phenanthroline)-Eu (III) complex contained in the electron transport layer was reported by T. Sano, M. Fujita, T. Fujii, and Y. Hamada in Japanese Journal of Applied Physics, vol. 34, Part 1, No. 4A, pp. 1883–1887.

As mentioned above, it is possible to produce red light by means of a variety of luminescent materials; however, there still remain problems to be solved about color purity, luminance, and stability. A new luminescent material for red light is to be developed.

An organic EL element of single-hetero structure (as shown in FIG. 4) was reported by C. W. Tang and S. A. VanSlyke in Applied Physics Letters, vol. 51, No. 12, pp. 913–915 (1987). This EL element is of two-layer structure, composed of an organic thin film of hole transporting material and a thin film of electron transporting material, so that it emits light upon recombination of holes and electrons injected into the organic thin film from respective electrodes.

The double-layer structure contributes to a great reduction in driving voltage and improvement in luminous efficiency, because either the hole transporting material or the electron transporting material functions also as the luminescent material and light emission takes place in the wavelength band corresponding to the energy gap between the ground state and the excited state of the luminescent material.

Later, an EL element of double-hetero structure (which is composed of three layers of hole-transporting material, luminescent material, and electron-transporting material) was reported by C. Adachi, S. Tokito, and S. Saito in Japanese Journal of Applied Physics, vol. 27, No. 2, pp. L269–L271 (1988). In addition, an EL element constructed such that the electron transporting material contains the luminescent material, was reported by C. W. Tang, S. A. VanSlyke, and C. H. Chen in Journal of Applied Physics, vol. 65, No. 9, pp. 3610–3616 (1989).

These studies proved the feasibility of an EL element which emits high-luminance light at a low voltage. Active researches and developments in such an EL element are under way.

As a matter of fact, there are many problems for solution before it is put to practical use. Above all, what is important is the development of a luminescent material which emits red light with a high color purity and a stable high luminance. Known examples of the red luminescent material include red fluorescent organic dyes and europiumametal complexes; however, they are not satisfactory.

As for the fluorescent organic dye, an EL element that employs 4-dicyanomethylene-2-methyl-6-(p-dimethylaminostyryl)-4H-pyran contained in the electron transporting material, was reported by C. W. Tang, S. A. VanSlyke, and C. H. Chen in Applied Physics Letters, vol. 51, No. 12, pp. 913–915 (1987).

Also, an organic EL element (for white light) that employs Nile Red (as the red luminescent material) contained in the electron transporting material, was reported by J. Kido, M. Miura, and K. Nagai in Science vol. 267, pp. 1332–1334 (1995).

OBJECT AND SUMMARY OF THE INVENTION

The present invention was completed in view of the above-foregoing. It is an object of the present invention to provide an electroluminescent element which emits red light (among the three primary colors: R (red), G (green), and B (blue)) with a high color purity and a stable high luminance and a luminescent display employing the same.

In order to achieve the above-mentioned object, the present inventors carried out a series of researches which led to the finding of an effective means. The present invention is based on this finding.

The first aspect of the present invention resides in an electroluminescent element of the type having formed on the electrode a layer of organic compound constituting the luminescent zone, characterized in that the luminescent zone contains quaterterrylene or a derivative thereof as the luminescent material. The second aspect of the present invention resides in a luminescent display with such electroluminescent element.

The electroluminescent element of the present invention stably emits light on account of the quaterterrylene or a derivative thereof.

DETAILED DESCRIPTION OF THE INVENTION

In a preferred embodiment of the electroluminescent element, the quaterterrylene or a derivative thereof is one which is presented by the formula below.

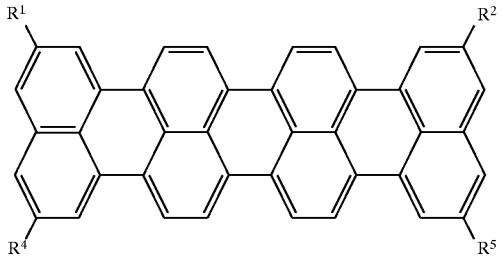

(where $R^1$, $R^2$, $R^3$, and $R^4$ may be identical or different, each denoting a hydrogen atom, alkyl group, alkoxy group, or a substituted or unsubstituted phenyl group.)

In a preferred embodiment of the electroluminescent element, the luminescent zone is typically a hole transport layer of organic compound, which contains quaterterrylene or a derivative thereof.

In a preferred embodiment of the electroluminescent element, the luminescent zone is typically an electron transport layer of organic compound, which contains quaterterrylene or a derivative thereof. In this case, the electron transport layer of organic compound may function also as the luminescent layer.

In a preferred embodiment of the electroluminescent element, the hole transport layer of organic compound and the electron transport layer of organic compound hold between them a luminescent layer of organic compound which contains quaterterrylene or a derivative thereof.

In a preferred embodiment of the electroluminescent element, the anode, hole transport layer of organic compound, electron transport layer of organic compound, and cathode are sequentially placed one over another on an optically transparent substrate.

The electroluminescent element mentioned above can be designed for use as a color display.

EXAMPLES

The invention will be described in more detail with reference to the following examples, which are not intended to restrict the scope of the invention.

Figure 4:
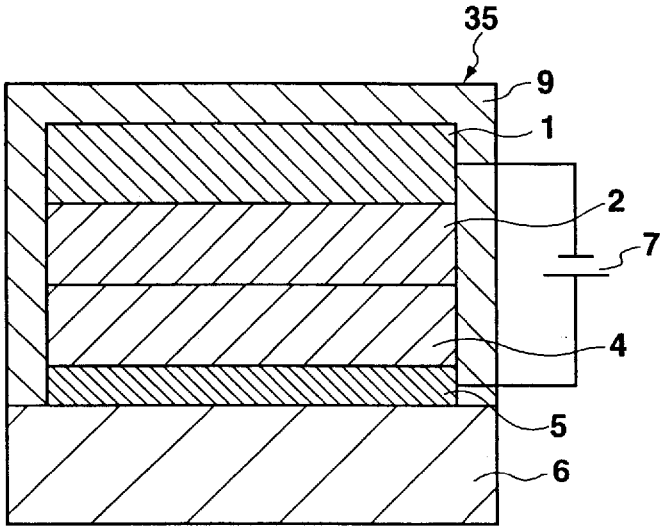
FIG. 4 is a schematic sectional view showing important parts of an organic EL element in Working Example of the present invention.
Figure 5:
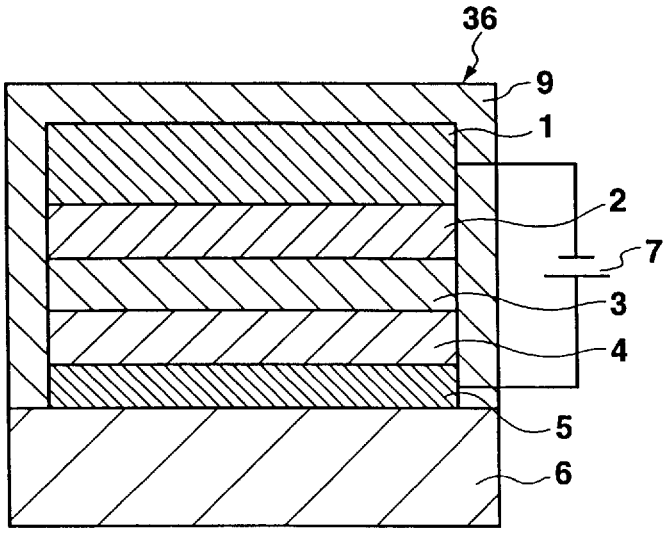
FIG. 5 is a schematic sectional view showing important parts of another organic EL element in Working Example of the present invention.

FIG. 4 is a schematic sectional view showing the organic EL element 35 of single-hetero structure pertaining to the example. FIG. 5 is a schematic sectional view showing the organic EL element 36 of double-hetero structure pertaining to the example.

These organic EL elements 35 and 36 employ as the luminescent material quaterterrylene or a derivative thereof represented by the following formula (I):

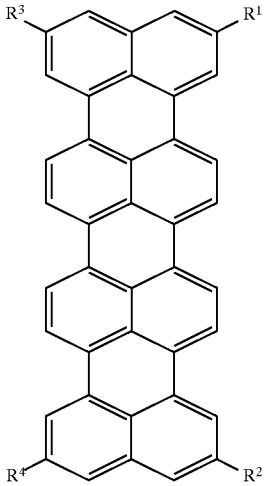

(I)

wherein $R^1$, $R^2$, $R^3$, and $R^4$ may be identical or different, each denoting a hydrogen atom, alkyl group, alkoxy group, or a substituted or unsubstituted phenyl group.

The organic EL element shown in FIG. 4 is composed of a substrate 6 (of glass, for example), a transparent ITO electrode 5 which functions as the anode, a hole transport layer 4, an electron transport layer 2, and an electrode 1 (of aluminum, for example) which functions as the cathode, which are consecutively arranged one over another. The electron transport layer 2 or the hole transport layer 4 contains the above-mentioned quaterterrylene or a derivative thereof (in an amount of 1–50 wt %, preferably 1–10 wt %), so that it functions as the luminescent layer.

The organic EL element shown in FIG. 5 is composed of a substrate 6 (of glass, for example), a transparent electrode 5 which functions as the anode, a hole transport layer 4, a luminescent layer 3, an electron transport layer 2, and an electrode 1 (of aluminum, for example) which functions as the cathode, which are consecutively arranged one over another. This structure is characterized by the independent luminescent layer 3 (preferably 5–50 nm thick) of quaterterrylene or a derivative thereof, which is held between the hole transport layer 4 and the electron transport layer 2.

In these organic EL elements 35 and 36 pertaining to the example, the substrate 6 may be made of glass or any other appropriate material such as plastics.

The transparent electrode 5 may be made of ITO or $SnO_2$. A thin film of organic compound or organometallic compound may be interposed between the transparent electrode 5 and the organic layer in order to achieve efficient charge injection.

The hole transport layer 4 may be formed from any of known many materials such as aromatic amines and pyrazolines. The hole transport layer 4 may be of single-layer structure or a multi-layer structure for improved charge transport. In the case where quaterterrylene or a derivative thereof is used for the hole transport layer 4, it is desirable that it be contained in at least one of the hole transport layers.

The quaterterrylene or a derivative thereof may be used alone as a single layer or contained in the electron transport material. The luminescent layer 3 may be of single-layer structure or multi-layer structure. In the latter case, a thin film of the electron transport material is combined with a thin film of the electron transport material containing the luminescent material. Alternatively, a thin film of the electron transport material is combined with a thin film of the luminescent material alone.

The electron transport layer 4 may be made of a complex compound of metal (such as aluminum and zinc), aromatic hydrocarbon, or oxadiazole compound.

The cathode 1 may be made of an alloy of Ag, Al, or In with an active metal (such as Li, Mg, and Ca) or may be composed of multiple layers of such metals. The cathode 1 may vary in thickness so that the organic EL element (of transmission type) has a desired transmittance according to the intended use. This object is achieved effectively if the metal electrode 1 is provided with a transparent electrode of ITO which ensures a stable electrical connection.

The protective layer 9 may be formed from any material which covers the organic EL element 35 or 36 entirely to provide airtight seal.

As mentioned above, quaterterrylene or a derivative thereof may be contained in the hole transport layer 4, the luminescent layer 3, and the electron transport layer 2. Moreover, for improvement in luminescence efficiency, the hole transport layer 4 and the electron transport layer 2 may be combined with a thin layer that controls the transport of holes or electrons.

The quaterterrylene derivative used in this example is characterized in that in formula (I) $R^1$, $R^2$, $R^3$, and $R^4$ are all tert-butyl groups. It is synthesized according to the steps shown in the following scheme.

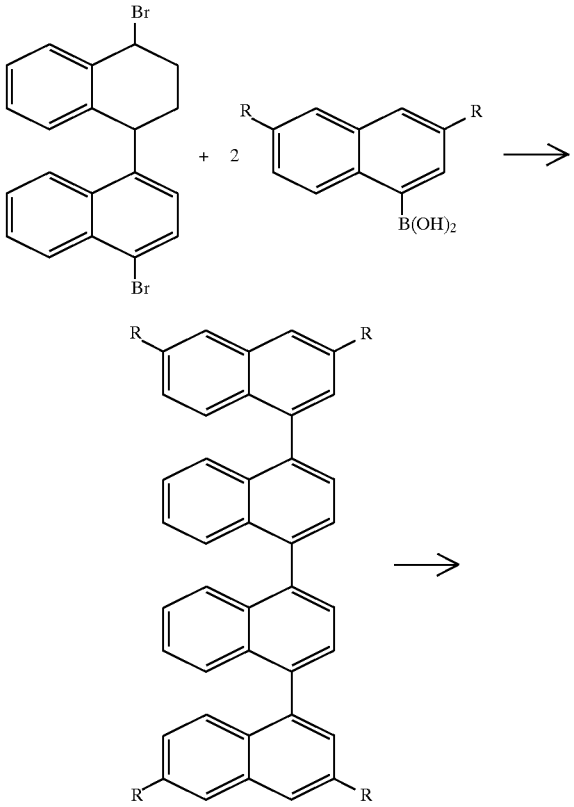

-continued

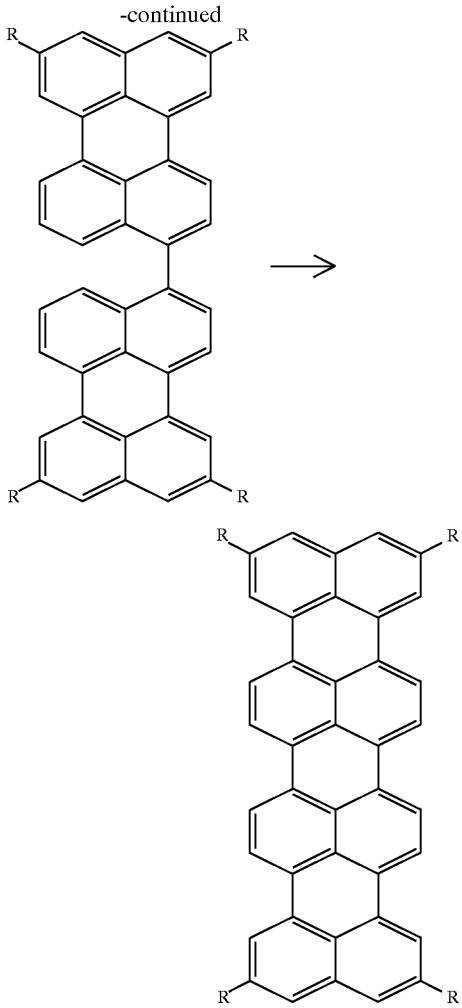

The quaterterrylene or a derivative thereof used in this example can be synthesized by the process reported by Karl-Heinz Kock and Klaus Muellen in Chem. Ber., vol. 124, pp. 2091–2100 (1991). As shown in the foregoing scheme, this process starts with 2,7-substituted naphthalene corresponding to the substituent groups in the final reaction product. It is brominated into 1-bromo-3,6-substituted naphthalene. The bromine is changed into boric acid. The resulting compound is combined with 1,4-bromonaphthalene through coupling. Upon anionic cyclization, there is obtained the desired product.

The process will be explained concretely with reference to the synthesis of 2,5,12,15-tetra-tert-butylquaterterrylene (in which $R^1$, $R^2$, $R^3$, and $R^4$ are all tert-butyl groups). This procedure may be applied to the synthesis of other derivatives.

2,7-Di-tert-butylnaphthalene as the starting material was prepared in the following manner. 200 g of naphthalene was mixed with 480 g of tert-butylchloride. To the mixture was added 300 mg of aluminum chloride. After vigorous reaction with evolution of gaseous hydrogen chloride for about 30 minutes, there was obtained a solid reaction mixture. To complete reaction, the mixture was heated on a water bath for 3 hours. The mixture was allowed to stand at room temperature for 8 hours.

The solid mixture was dissolved in 3.3 liters of boiling ethanol, and 210 g of thiourea was added to the solution. After cooling and filtration, the filtrate was treated in the same manner as above with 210 g of thiourea and then with 80 g of thiourea.

With the solvent removed, the residues were crushed in 300 ml of water. After extraction with chloroform three times, the organic layer was dried over magnesium sulfate and filtered. Upon solvent evaporation, there was obtained the desired product (125 g) in a yield of 34% based on naphthalene.

Subsequently, 2,7-di-tert-butylnaphthalene underwent bromination to give 1-bromo-3,6-di-tert-butylnaphthalene in the following manner. 33 g of 2,7-di-tert-butylnaphthalene was dissolved in 400 ml of carbon tetrachloride. To this solution was added a catalytic amount (300 mg) of iron powder, and then 22.4 mg of bromine (dissolved in 100 ml of carbon tetrachloride) was added dropwise through a dropping funnel over 1 hour at room temperature. The reaction was carried out in a dark place. After stirring for 8 hours, 300 ml of aqueous solution of sodium hydride (0.5M) was added for hydration. The resulting mixture was stirred for 1 hour.

The organic layer was separated and dried over sodium sulfate and filtered. On solvent evaporation and recrystallization from methanol, there was obtained the desired product (27 g) in a yield of 80%.

The thus obtained 1-bromo-3,6-di-tert-butylnaphthalene underwent oxidation with boron in the following manner. 25 g of this compound was dissolved in 250 ml of dry diethyl ether, and the solution was cooled to −78° C. under a nitrogen atmosphere. Into the solution was injected 2.5M of butyl lithium (in 38 ml of hexane solution) through a syringe. After stirring for 1 hour, the cooling bath was removed.

44.2 g of triisopropoxyborane was dried and dissolved in 250 ml of diethyl ether. (This amount is equivalent to 2.8 times the molar amount of aryl bromide.) The resulting solution was placed in a reaction vessel and cooled to −78° C. under a nitrogen atmosphere. With vigorous stirring, the previously prepared organolithium compound was added slowly over about 1 hour through a jacketed metal pipe. The resulting mixture was stirred at a low temperature for 1 hour and then at room temperature for 8 hours.

Subsequently, the mixture was hydrated with 300 ml of 2M aqueous solution of hydrochloric acid for 30 minutes. The resulting solution was separated into two layers. The organic layer was dried over magnesium sulfate and the solvent was evaporated. Residues were dissolved in 100 ml of petroleum ether, and 10 ml of water was added to the solution and the resulting mixture was stirred at room temperature.

About 12 hours later, colorless fine crystalline precipitates were obtained. The precipitates were filtered off with suction, washed with a small amount of petroleum ether, and dried in a vacuum desiccator (at 60° C. and 20 Torr). There was obtained 3,6-di-tert-butyl-1-(dihydroxyboryl) naphthalene (15 g) in a yield of 67%. It has a melting point of 270° C. which agrees with the value in literature.

The 3,6-di-tert-butyl-1-(dihydroxyboryl)naphthalene underwent coupling reaction with 4,4'-dibromo-1,1'-binaphthyl in the following manner by the aid of palladium catalyst under a nitrogen atmosphere in the dark.

In 20 ml of toluene were suspended 3,6-di-tert-butyl-1-(dihydroxyboryl)naphthalene (3.0 g, 10.6 mmol), 4,4'-dibromo-1,1'-binaphthyl (1.98 g, 4.8 mmol), and tetrakis (triphenylphosphine)palladium(0) (340 mg, 0.3 mmol). To the suspension was added 10 ml of 2M aqueous solution of potassium carbonate. The resulting mixture was refluxed for 3 days with vigorous stirring.

The reaction product was purified by silica gel chromatography, with elution by cyclohexane which was gradually diluted with chloroform until the ratio of cyclohexane/chloroform reached 5:1 v/v. The purity of the desired product was confirmed by thin-layer chromatography developed with petroleum ether. After solvent evaporation, there was obtained 3,3'''',6,6''''-tetra-tert-butyl-1,1':4', 1":4",1'''-quaterterrylene (2.7 g) in a yield of 69%. It has a melting point of 236°–238° C. which agrees with the value in literature.

The 3,3'''',6,6''''-tetra-tert-butyl-1,1':4',1":4",1'''-quaterterrylene underwent cyclization reaction in two steps. First, it was converted into 8,8',1,11'-tetra-tert-butyl-3,3'-biperylenyl, which was subsequently cyclized to give 2,5, 12,15-tetra-tert-butylquaterterrylene as the desired product. The reaction in the first step was carried out in dry pure argon gas.

In the first step, 2.3 g of 3,3'''',6,6''''-tetra-tertbutyl-1,1':4', 1":4",1'''-quaterterrylene was dissolved in 150 ml of dry 1,2-dimethoxyethane. This operation was carried out under an argon stream by using a Schlenk-type flask. To the solution was added 1.8 g of potassium (in small pieces with oxide layer removed). The solution underwent freezing and thawing repeatedly in a vacuum and the flask was evacuated to $10^{-3}$ Torr.

With the flask evacuated and sealed, the content was stirred for reaction at room temperature for 7 days. Residual potassium was removed under an argon stream, and then 2.5 g of freshly sublimed cadmium chloride was added. The reaction mixture was stirred for one day and then filtered, and solids were washed with chloroform. Upon purification by chromatography (cyclohexane/chloroform 1:0→5:1 v/v), there was obtained 8,8',1,11'-tetra-tert-butyl-3,3'-biperylenyl (1.1 g) in a yield of 48%.

In the second step, 500 mg of 8,8',1,11'-tetra-tertbutyl-3, 3'-biperylenyl was mixed with 500 mg of anhydrous aluminum chloride and 500 mg of anhydrous cupric chloride, and the mixture was stirred at room temperature for 8 hours in 80 ml of carbon disulfide under a nitrogen atmosphere. At the end of reaction, there occurred dark green precipitates. After decantation, the residues were treated with ice and dilute ammoniac aqueous solution for hydration. The resulting suspension was extracted repeatedly with a small amount of chlorobenzene (30 ml) until the organic layer did not assume a blue color due to 4*b* any longer.

The suspension was dried with magnesium sulfate, and then the organic layer was filtered out and the solvent was evaporated. The residues were suspended in 60 ml of chloroform, and 5 g of aluminum oxide was added to the suspension. After solvent removal by evaporation, there was obtained aluminum oxide coated with the reaction product. This product was purified to remove by-product (perylene dye) by aluminum oxide column chromatography (eluted with cyclohexane/chloroform 5:1 v/v).

The column packing was dried in nitrogen and then extracted with chloroform by refluxing to recover quaterterrylene. The extract was freed of solvent by evaporation and the resulting precipitates were filtered off. Thus there was obtained 240 mg of 2,5,12,15-tetra-tert-butylquaterterrylene as the desired product in a yield of 48%. It is a dark bluish solid assuming a reddish gloss. It gives remarkable fluorescence in a solution. It has a melting point of 520° C., which agrees with the value in literature.

Figure 6:
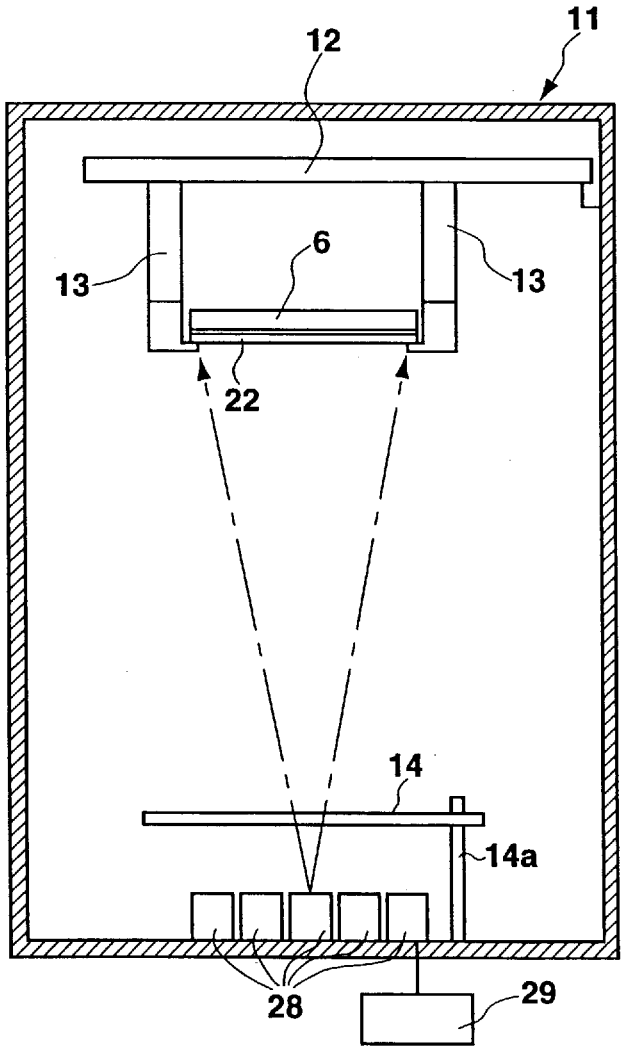
FIG. 6 is a schematic sectional view showing the vacuum deposition apparatus used in Working Examples.

The quaterterrylene (or a derivative thereof) prepared as mentioned above was used in the organic EL element 35 or 36 in the example explained above. The organic EL element is produced by using a vacuum deposition apparatus as shown in FIG. 6 (which is a schematic sectional view).

This apparatus 11 has an arm 12 and a pair of supporting means 13 fixed to the lower side thereof. Between the supporting means 13, 13 is held a stage mechanism (not shown) on which an inverted transparent glass substrate 6 and a mask 22 are placed. Under the glass substrate 6 and the mask 22 is a shutter 14 supported on a supporting shaft 14*a*. Under the shutter 14 are as many vapor sources 28 as necessary. Each source is resistance-heated by electricity supplied from the power unit 29. Resistance heating may be enhanced by electron beam heating, if necessary.

The mask 22 is used for patterning pixels and the shutter 14 is used for vapor deposition. The shutter 14 turns around the supporting shaft 14*a* so as to cut off the stream of vaporized material according to the sublimation temperature of the material.

Figure 7:
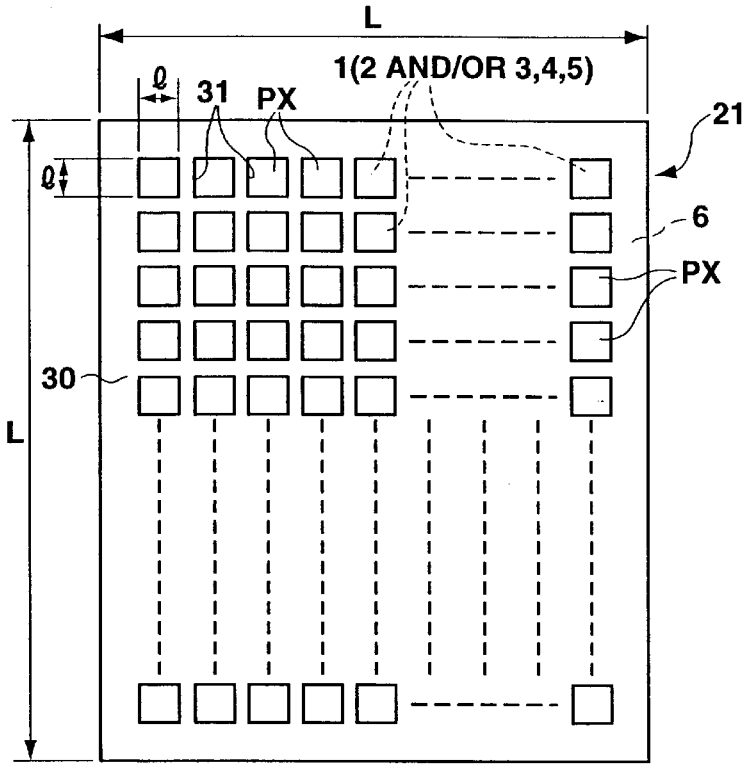
FIG. 7 is a plan view showing the organic EL element in Working Examples.
Figure 8:
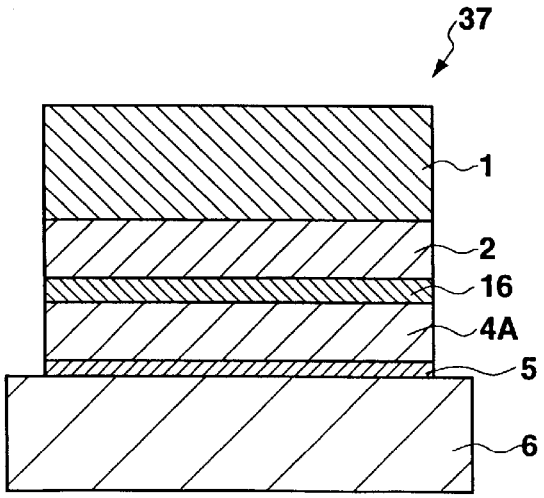
FIG. 8 is a schematic sectional view showing important parts of an embodiment of the organic EL element in Working Examples.
Figure 9:
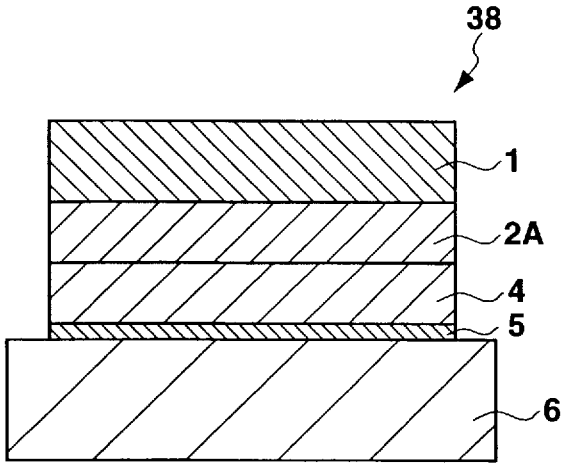
FIG. 9 is a schematic sectional view showing important parts of another embodiment of the organic EL element in Working Examples.
Figure 10:
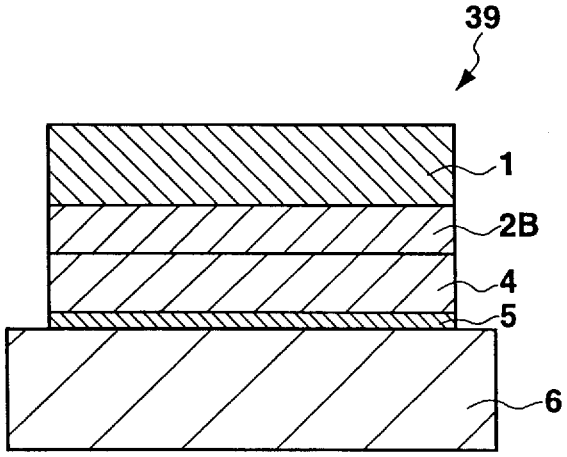
FIG. 10 is a schematic sectional view showing important parts of further another embodiment of the organic EL element in Working Examples.
Figure 11:
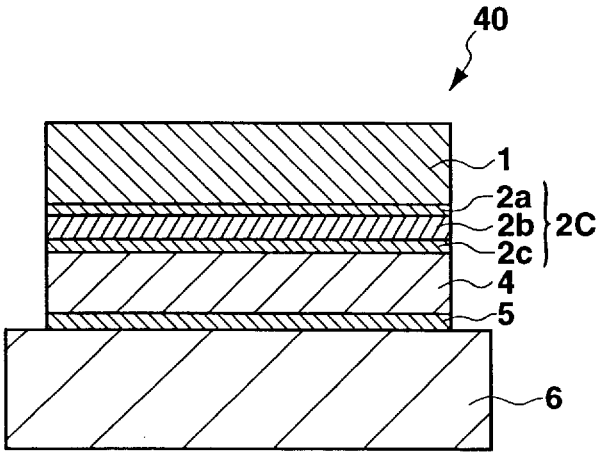
FIG. 11 is a schematic sectional view showing important parts of further another embodiment of the organic EL element in Working Examples.
Figure 12:
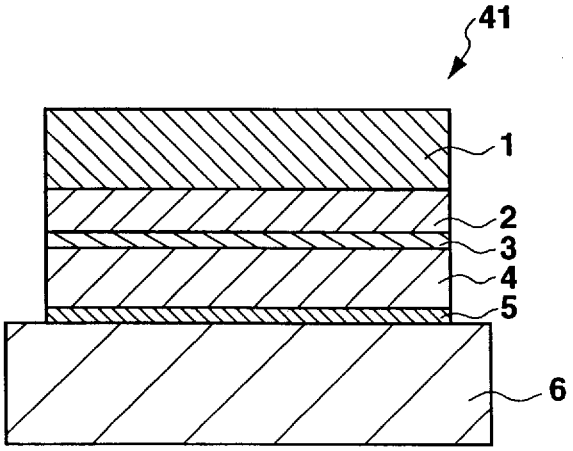
FIG. 12 is a schematic sectional view showing important parts of further another embodiment of the organic EL element in Working Examples.

FIG. 7 is a plan view showing an example of the organic EL element 21 produced by using the above-mentioned vacuum deposition apparatus. The process for production consists of coating a square glass substrate 6 (whose length L is 30 mm) with an ITO transparent layer of prescribed thickness by vacuum deposition, entirely covering the ITO transparent layer with $SiO_2$ 30 by vacuum deposition, etching the $SiO_2$ layer according to the desired pixel pattern to form a number of openings 31 (each measuring 2 mm square) through which ITO transparent electrodes 5 are exposed, and forming consecutively organic layers 4, 3, 2 and a metal electrode 1 on each pixel PX (2 mm square) by vacuum deposition through the mask 22.

The vacuum deposition apparatus 11 can produce not only a large number of small pixels (as shown in FIG. 7) but also a single large pixel.

Figure 1:
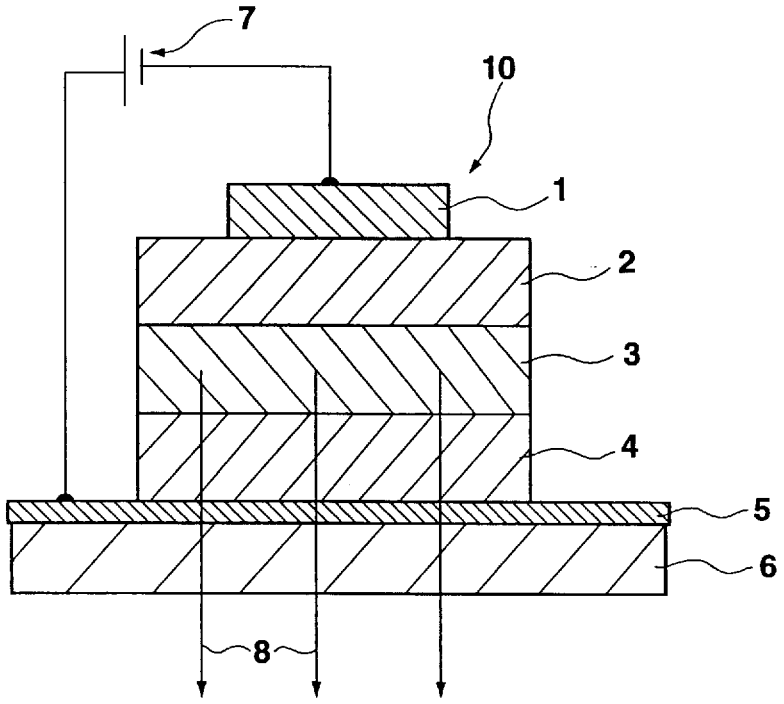
FIG. 1 is a schematic sectional view showing an example of the conventional organic EL element.
Figure 2:
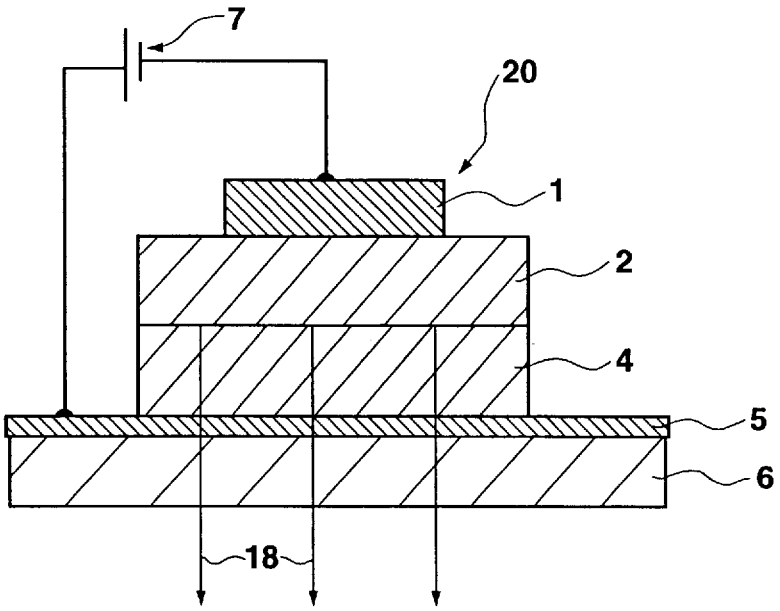
FIG. 2 is a schematic sectional view showing another example of the conventional organic EL element.
Figure 3:
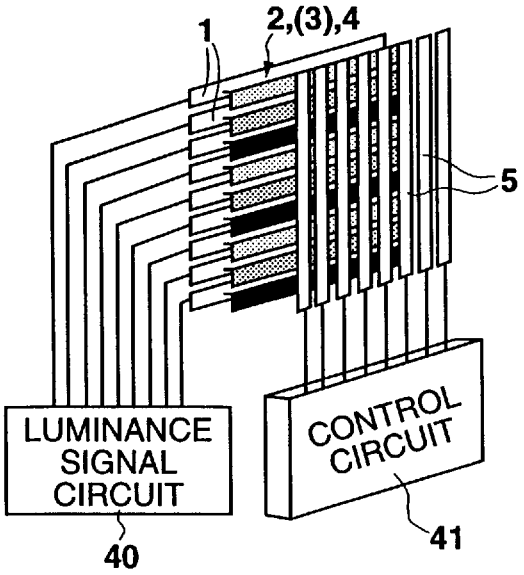
FIG. 3 is a schematic perspective view showing an example of the conventional organic EL element.

In this example, two types of organic EL elements were produced. The first one (shown in FIG. 1) has quaterterrylene or a derivative thereof (as the luminescent material) contained in the hole transport layer 4 or the electron transport layer 2. The second one has an independent luminescent layer of quaterterrylene or a derivative thereof between the hole transport layer 4 and the electron transport layer 2. They were tested for luminescent characteristics. A detailed description follows.

FIGS. 8 to 12 are schematic sectional views showing the organic EL elements in Working Examples.

Working Example 1

A glass substrate 6 was provided with ITO transparent electrodes 5 (each measuring 2 mm square) by vacuum deposition by using the apparatus 11 shown in FIG. 7. This substrate 6 was fixed to the supporting means 13, with a mask 22 placed underneath. The substrate 6 was 25 cm above the vapor sources 28, and the mask 22 has openings corresponding to the film pattern. With the apparatus evacuated below $10^{-6}$ Torr, the power unit 29 was energized to heat the sources 28 by resistance. The resulting element has a luminescent area of 2 mm by 2 mm (as in the following Working Examples).

On the ITO transparent electrode 5 was formed the hole transport layer 4 by vacuum deposition. It is a thin film composed of N,N'-diphenyl-N,N'-bis(3-methylphenyl)-1,1'-biphenyl-4,4'-diamine (TPD for short hereinafter) and quaterterrylene, which were supplied from individual sources in a mixing ratio of 10:1 by weight. During vacuum deposition, the rate of evaporation was monitored by means of a quartz oscillation-type film thickness gauge so as to control the composition of quaterterrylene or a derivative thereof (R=tert-butyl group in the formula above, as in the following working examples) contained in the film. The rate of evaporation was kept at 0.2–0.4 nm/s, and the thickness of the hole transport layer 4 was 50 nm.

On the hole transport layer 4 was formed the luminescence promoting layer 16 (15 nm thick) from 2,9-dimethyl-4,7-diphenyl-1,10-phenanthreline by vacuum deposition. This layer is intended to improve the efficiency of luminescence.

On the layer 16 was formed the electron transport layer 2 (50 nm thick) from tris-(8-hydroxyquinoline)aluminum ($Alq_3$ for short hereinafter). This layer was formed at a rate of 0.2–0.4 nm/s by monitoring evaporation with a quartz oscillation-type film thickness gauge.

On the electron transport layer 2 was formed an cathode 1 (200 nm thick) from aluminum by resistance heating using the vacuum deposition apparatus 11. In this way the organic EL element 37 was completed.

In this Working Example, TPD was used as the hole transport material and $Alq_3$ was used as the electron transport material. However, other materials may also be used, as in the following working examples.

Figure 13:
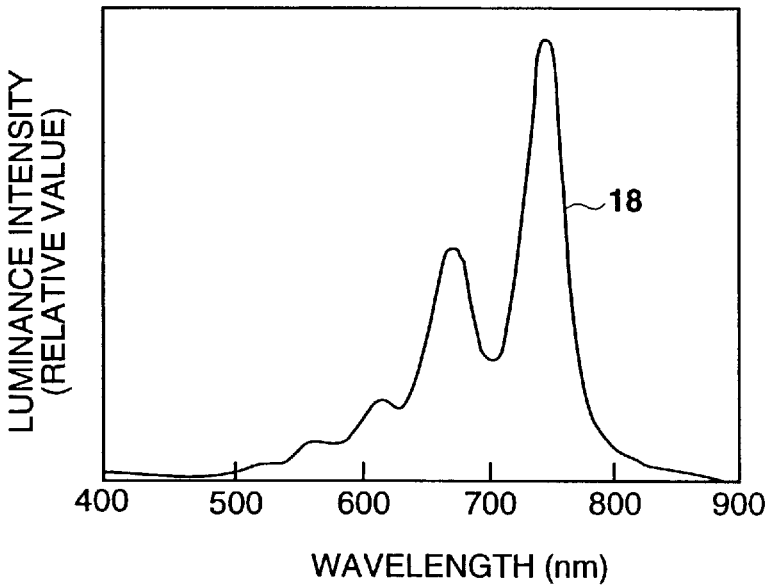
FIG. 13 is a graph showing the luminescent characteristics of the organic EL element (with quaterterrylene) in Working Examples.

The organic EL element 37 produced in Working Example 1 as mentioned above was tested for luminescent characteristics in a nitrogen atmosphere. (Spectrophotometry was carried out by using a spectroscope provided with a detector of photodiode array, made by Otsuka Denshi.) The results indicate that the EL element emits red light whose spectrum has a peak in the vicinity of 670 nm (red wavelength) as shown in FIG. 13. Although the spectrum also has a large peak in the vicinity of 750 nm, this peak is substantially outside the visible region and hence has no marked effect on the chromaticity.

The foregoing suggests that the luminescence is due to the quaterterrylene or a derivative thereof. The EL element increased in luminance and current in proportion to voltage applied to it. It gave a luminance of 420 cd/$m^2$ at 15 V, which remained stable without appreciable decrease during observation.

Working Example 2

As in Working Example 1, a glass substrate 6 was provided with ITO transparent electrodes 5, and a hole transport layer 4 (50 nm thick) was formed thereon from TPD by vacuum deposition at a rate of 0.2–0.4 nm/s.

On the hole transport layer 4 was formed an electron transport layer 2A (50 nm thick) by vacuum deposition at a rate of 0.2–0.4 nm/s from $Alq_3$ and quaterterrylene or a derivative thereof contained in separate boats. The mixing ratio of $Alq_3$ and quaterterrylene was 10:1 by weight. The rate of their evaporation was controlled individually by using two quartz oscillation-type film thickness gauges.

On the electron transport layer 2A was formed an cathode 1 (200 nm thick) from aluminum by resistance heating using the vacuum deposition apparatus 11. In this way the organic EL element 38 was completed.

The organic EL element 38 produced in Working Example 2 as mentioned above was tested for luminescent characteristics in a nitrogen atmosphere. (Spectrophotometry was carried out by using a spectroscope as in Working Example 1.) The results indicate that the EL element emits red light whose spectrum has a peak in the vicinity of 670 nm as in Working Example 1. This suggests that the luminescence is due to the quaterterrylene or a derivative thereof.

The EL element increased in luminance and current in proportion to voltage applied to it. It gave a luminance of 350 cd/$m^2$ at 11 V, which remained stable without appreciable decrease during observation. It was also found that the luminous intensity depends on the concentration of quaterterrylene or a derivative thereof in $Alq_3$, reaching a maximum at 0.1–2.0 mol % (preferably 0.2–1.0 mol %).

Working Example 3

As in Working Example 1, a glass substrate 6 was provided with ITO transparent electrodes 5, and a hole transport layer 4 (50 nm thick) was formed thereon from TPD by vacuum deposition at a rate of 0.2–0.4 nm/s.

On the hole transport layer 4 was formed an electron transport layer (20 nm thick, preferably 15–20 nm thick) by vacuum deposition at a rate of 0.2–0.4 nm/s from quarterterrylene or a derivative thereof. This electron transport layer functions also as a luminescent layer.

On the electron transport layer was formed an anode 1 (200 nm thick) from aluminum by resistance heating using the vacuum deposition apparatus 11. In this way the organic EL element 39 was completed.

The organic EL element 39 produced in Working Example 3 as mentioned above was tested for luminescent characteristics in a nitrogen atmosphere. (Spectrophotometry was carried out by using a spectroscope as in Working Example 1.) The results indicate that the EL element emits red light whose spectrum has a peak in the vicinity of 670 nm as in Working Example 1. This suggests that the luminescence is due to the quaterterrylene or a derivative thereof.

The EL element increased in luminance and current in proportion to voltage applied to it. It gave a luminance of 220 cd/$m^2$ at 19 V, which remained stable without appreciable decrease during observation. A probable reason for a low luminance at a higher voltage despite the thinner electron transport layer 2B than in Working Example 2 is that quaterterrylene or a derivative thereof is inferior to $Alq_3$ in electron transport performance.

Working Example 4

As in Working Example 1, a glass substrate 6 was provided with ITO transparent electrodes 5, and a hole transport layer 4 (50 nm thick) was formed thereon from TPD by vacuum deposition at a rate of 0.2–0.4 nm/s.

On the hole transport layer 4 was formed an electron transport layer 2C of three-layer structure by vacuum deposition from $Alq_3$ and quaterterrylene or a derivative thereof contained in separate boats. The outer layers 2*a*, 2*c* are formed from $Alq_3$ alone and the middle layer 2*b* was formed from a mixture of $Alq_3$ and quaterterrylene in a mixing ratio of 10:1 by weight. The rate of their evaporation was controlled individually by using two quartz oscillation-type film thickness gauges.

The electron transport layer 2C of three-layer structure was formed in the following manner. First, the first outer layer 2*c* (10 nm thick) was formed from $Alq_3$ alone by vacuum deposition. Then, the middle layer 2*b* (5–40 nm thick, preferably 10–30 nm thick) wad formed from $Alq_3$ and quaterterrylene (or a derivative thereof) together by vacuum deposition. Finally, the second outer layer 2*a* was formed from $Alq_3$ alone by vacuum deposition so that the electron transport layer 2C had a total thickness of 50 nm. The rate of evaporation was kept at 0.2–0.4 nm/s as in the case of hole transport layer.

On the electron transport layer was formed an cathode 1 (200 nm thick) from aluminum by resistance heating using the vacuum deposition apparatus 11. In this way the organic EL element 40 was completed.

The organic EL element 40 produced in Working Example 4 as mentioned above was tested for luminescent characteristics in a nitrogen atmosphere. (Spectrophotometry was carried out by using a spectroscope as in Working Example 1.) The results indicate that the EL element emits red light whose spectrum has a peak in the vicinity of 670 nm as in Working Example 1. This suggests that the luminescence is due to the quaterterrylene or a derivative thereof.

The EL element was tested for luminance which changes with voltage applied. It was found that the luminous intensity depends on the concentration of quaterterrylene or a derivative thereof in $Alq_3$, reaching a maximum at 0.1–2.0 mol % (preferably 0.2–1.0 mol %) as in Working Example 2.

The EL element increased in luminance and current in proportion to voltage applied to it. It gave a luminance of 440 cd/$M^2$ at 12 V, which remained stable without appreciable decrease during observation. A probable reason for the higher luminance than in Working Example 2 is that the optimal recombination of holes and electrons occurs in the specified region so that energy moves smoothly from $Alq_3$ (in excited state) to quaterterrylene or a derivative thereof.

Working Example 5

As in Working Example 1, a glass substrate 6 was provided with ITO transparent electrodes 5, and a hole transport layer 4 (50 nm thick) was formed thereon from TPD by vacuum deposition.

On the hole transport layer 4 was formed a luminescent layer 3 (10 nm thick, preferably 10–15 nm thick) from quaterterrylene or a derivative thereof.

On the luminescent layer 3 was formed an electron transport layer 2 (50 nm thick) from $Alq_3$ by vacuum deposition. The rate of evaporation for the luminescent layer 3 and the electron transport layer 2 was kept at 0.2–0.4 nm/s by means of a quartz oscillation-type film thickness gauge.

On the electron transport layer 2 was formed an cathode 1 (200 nm thick) from aluminum by resistance heating using the vacuum deposition apparatus 11. In this way the organic EL element 41 was completed.

The organic EL element 41 produced in Working Example 5 as mentioned above was tested for luminescent characteristics in a nitrogen atmosphere. The results indicate that the EL element emits red light whose spectrum has a peak in the vicinity of 670 nm as in Working Example 1. This suggests that the luminescence is due to the quaterterrylene or a derivative thereof.

The EL element increased in luminance and current in proportion to voltage applied to it. It gave a luminance of 320 cd/$m^2$ at 13 V, which remained stable without appreciable decrease during observation.

FIG. 13 is a graph showing the luminescence characteristics of the organic EL element 37 in Working Example 1. This graph typifies those in Working Examples 2 to 5. It is characterized by having a peak at about 670 nm in the visible region (400–700 nm).

The foregoing Working Examples demonstrate that the luminescent material of the present invention opens up a road to a luminescent red color suitable for display in terms of stability, chromaticity, and luminance. (The only luminescent color now available is green, and blue and red colors have been under development.) Therefore, the organic EL element in Working Examples will be effectively used for monocolor (red) displays, or it may be combined with any other known luminescent materials for blue and green if it is to be used for full-color displays.

As mentioned above, the organic EL element of the present invention is composed of a glass substrate 6, a transparent anode layer 5, organic layers 4 and 2, and a metal cathode 1. Quaterterrylene or a derivative thereof as the luminescent material may be contained in the organic layers or held between the hole transport layer 4 and the electron transport layer 2. In either case, it greatly contributes to red luminescence.

The organic EL element constructed as mentioned above emits red light with a sufficient luminance owing to quaterterrylene or a derivative thereof. The spectrum of the red light is shown in FIG. 13. According to the present invention, it is possible to add quaterterrylene or a derivative thereof to any layer in the organic EL element. This offers a wide choice of construction for efficient red luminescence.

The quaterterrylene or a derivative thereof in the present invention permits easy introduction of substituent groups (R) suitable for red luminescence according to the process of synthesis mentioned above. It can be deposited alone or in combination with the electron or hole transport material to form a film of desired thickness. In the latter case, the concentration of quaterterrylene in the film can be controlled as desired. This facilitates the production of the organic EL element.

The organic EL element in Working Examples emits stable red light because the luminescent zone contains quarterterrylene or a derivative thereof. This suggests the usefulness of quaterterrylene as a red luminescent material which has not been practically available for display. At present, green is the only luminescent color that can be used for display satisfactorily in terms of stability, chromaticity, and luminance.

The foregoing description is a preferred embodiment of the invention and various changes and modifications may be made in the invention without departing from the spirit and scope thereof.

In the chemical formula above representing quarterterrylene or a derivative thereof, R may be an alkyl group other than tert-butyl group, such as methyl group, ethyl group, n-propyl group, i-propyl group, and n-butyl group. An alkyl group having 1–5 carbon atoms is desirable. Moreover, R may be an alkoxy group substituted with said alkyl group, an unsubstituted phenyl group or a phenyl group substituted with said alkyl group, or a hydrogen atom (in this case R is not a substituent group).

The quaterterrylene or a derivative thereof may be used alone as the luminescent material or in combination with any other known luminescent material. Either single-layer structure or multi-layer structure may be employed for the ITO transparent electrode 5, hole transport layer 4, luminescent layer 4, electron transport layer 2, and metal electrode 1 of the organic EL element in Working Examples.

Vapor deposition used in Working Examples to form the luminescent layer of organic compound may be replaced by any other method involving sublimation or vaporization.

The cathode electrode, electron transport layer, hole transport layer, and anode electrode may be formed from any other materials than mentioned above. For example, the hole transport material may be formed from benzidine derivatives, styrylamine derivatives, triphenylmethane derivatives, hydrazone derivatives, etc. Likewise, the electron transport layer may be formed from perylene derivatives, bisstyryl derivatives, and pyrazine derivatives.

The anode electrode should preferably be formed from a metal having a low work function for efficient electron injection. Examples of such a metal include, in addition to aluminum-lithium alloy, aluminum, indium, magnesium, silver, calcium, barium, and lithium. They may be used in the form of simple substance or alloy with other metals for improved stability.

In Working Examples, a transparent ITO electrode was used as the cathode electrode so that the luminescent light is visible through it. However, for efficient hole injection, the cathode electrode may be formed from gold, tin dioxide-antimony mixture, or zinc oxide-aluminum mixture which has a low work function.

Needless to say, the organic EL element of the present invention can be used for monocolor display. It can also be used for full-color or multi-color display if adequate luminescent materials are chosen for three colors (R, G, B). It can also be used as a light source or for any other optical applications.

What is claimed is:

1. An electroluminescent element of the type having a cathode, an anode, and an organic layer which contains a luminescent zone and is held between said cathode and anode, characterized in that said luminescent zone contains quaterterrylene or a derivative thereof as the luminescent material.

2. An electroluminescent element as defined in claim 1, wherein the quaterterrylene or a derivative thereof is one which is presented by the formula below

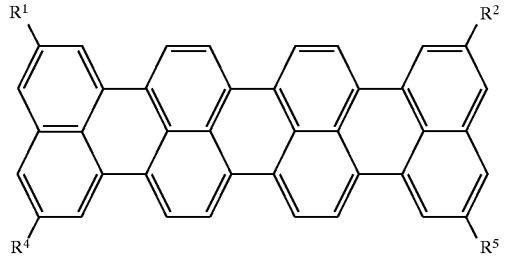

(where $R^1$, $R^2$, $R^3$, and $R^4$ may be identical or different, each denoting a hydrogen atom, alkyl group, alkoxy group, or a substituted or unsubstituted phenyl group).

3. An electroluminescent element as defined in claim 1, wherein the luminescent zone is typically a hole transport layer of organic compound, which contains quaterterrylene or a derivative thereof.

4. An electroluminescent element as defined in claim 1, wherein the luminescent zone is typically an electron transport layer of organic compound, which contains quaterterrylene or a derivative thereof.

5. An electroluminescent element as defined in claim 1, wherein the electron transport layer of organic compound serves also as a luminescent layer and it contains quaterterrylene or a derivative thereof.

6. An electroluminescent element as defined in claim 1, wherein the hole transport layer of organic compound and the electron transport layer of organic compound hold between them a luminescent layer of organic compound which contains quaterterrylene or a derivative thereof.

7. An electroluminescent element as defined in claim 1, wherein the anode contains at least one member selected from ITO (Indium Tin Oxide), gold, tin dioxide-antimony mixture, and zinc oxide-aluminum mixture.

8. An electroluminescent element as defined in claim 1, wherein the anode contains at least one member selected from aluminum-lithium alloy, aluminum, indium, magnesium, calcium, barium, and lithium.

9. An electroluminescent element which comprises an optically transparent substrate, an anode, an organic hole transport layer, an organic electron transport layer, and a cathode, which are sequentially arranged one over another, said organic hole transport layer serving as the main luminescent zone and containing quaterterrylene or a derivative thereof.

10. An electroluminescent element which comprises an optically transparent substrate, an anode, an organic hole transport layer, an organic electron transport layer, and a cathode, which are sequentially arranged one over another, said organic electron transport layer serving as the main luminescent zone and containing quaterterrylene or a derivative thereof.

11. An electroluminescent element which comprises an optically transparent substrate, an anode, an organic hole transport layer, an organic electron transport layer, and a cathode, which are sequentially arranged one over another, said organic electron transport layer (which functions also as the luminescent layer) serving as the luminescent zone and containing quaterterrylene or a derivative thereof.

12. An electroluminescent element which comprises an optically transparent substrate, an anode, an organic hole transport layer, an organic electron transport layer, and a cathode, which are sequentially arranged one over another, said luminescent layer serving as the luminescent zone and containing quaterterrylene or a derivative thereof.

13. A self-luminous display emitting three primary colors of red, green, and blue, characterized in that light is emitted from an electroluminescent element composed of a cathode, an anode, and an organic layer which contains the luminescent zone and is held between said cathode and anode and said luminescent zone contains as the luminescent material quaterterrylene or a derivative thereof.

* * * * *